US006287157B1

(12) United States Patent
Suzuki et al.

(10) Patent No.: US 6,287,157 B1
(45) Date of Patent: Sep. 11, 2001

(54) CONNECTOR ASSEMBLY

(75) Inventors: Izumi Suzuki; Yukihiro Fukatsu, both of Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 0 days.

(21) Appl. No.: 09/525,463

(22) Filed: Mar. 15, 2000

(30) Foreign Application Priority Data

| | | |
|---|---|---|
| Mar. 16, 1999 | (JP) | 11-069998 |
| Apr. 5, 1999 | (JP) | 11-097773 |
| Apr. 13, 1999 | (JP) | 11-105930 |

(51) Int. Cl.[7] ..... H01R 11/22
(52) U.S. Cl. ..... 439/851; 439/877
(58) Field of Search ..... 439/851, 857, 439/860, 877, 882, 274, 275, 587, 589

(56) References Cited

U.S. PATENT DOCUMENTS

| | | | | |
|---|---|---|---|---|
| 5,067,916 | * | 11/1991 | Denlinger et al. | 439/857 |
| 5,478,263 | | 12/1995 | Kato . | |
| 5,487,686 | * | 1/1996 | Sawada | 439/884 |
| 5,516,311 | | 5/1996 | Maejima . | |
| 5,545,062 | * | 8/1996 | Takagishi et al. | 439/877 |
| 5,775,960 | * | 7/1998 | Saito et al. | 439/843 |
| 5,788,542 | | 8/1998 | Miwa | 439/851 |
| 5,904,600 | * | 5/1999 | Tamita et al. | 439/877 |
| 5,989,078 | * | 11/1999 | Chailot et al. | 439/851 |

FOREIGN PATENT DOCUMENTS

| | | |
|---|---|---|
| 198 01 539 A 1 | 7/1998 | (DE) . |
| 0 923 159 A2 | 8/1998 | (EP) . |
| 8-306420 | 11/1996 | (JP) . |

* cited by examiner

*Primary Examiner*—Tulsidas Patel
(74) *Attorney, Agent, or Firm*—Oliff & Berridge, PLC

(57) ABSTRACT

A connector assembly is disclosed, including a terminal. The terminal has a connection portion which in use contacts a mating terminal. An electrical wire connection portion connected to an electrical wire is provided rearward from the connection portion. The height of the connection portion is greater than that of the wire connection portion. A guard member projects from each of two side walls located between the connection portion and the wire connection portion. When an electrically conductive plate material is cut and bent to form the terminal, each guard member is formed integral with the respective side wall, and a tip of each guard member is folded inward to prevent a sharp edge from being exposed to the outside. A periphery of a terminal insertion opening in a resilient sealing member of the connector housing is prevented from being damaged when pressing the terminal into a terminal insertion opening of the resilient sealing member or when removing it therefrom.

10 Claims, 8 Drawing Sheets

CONNECTOR ASSEMBLY

BACKGROUND OF THE INVENTION

1. Field of Invention

The present invention relates to a connector component and an electrical terminal, particularly for use in a wiring system of a vehicle, such as an automobile.

2. Description of Related Art

U.S. Pat. No. 5,788,542 and JP-A-8-306420 disclose examples of known terminals for electrical wires. FIG. 7 of the present drawings shows a typical conventional terminal 100 before it is installed in a connector housing 104. A resilient sealing member 106 is installed on the connector housing 104. The terminal 100 is pressed through a terminal insertion opening 101 formed through the resilient sealing member 106.

The terminal 100 is formed by cutting and bending an electrically conductive plate material, e.g. by press-working. A connection portion 102 that in use is connected with a tab of a mating male-side terminal (not shown) is provided at a front half portion of the terminal 100. An electrical wire connection portion 103 that is connected with an electrical wire W is formed rearward from the connection portion 102.

The diameter of the opening 101 is smaller than the outer diameter of the connection portion 102. Thus, when an operation of pressing the terminal 100 into the opening 101 is performed, the periphery of the opening 101 is elastically expanded. To prevent a sharp (e.g. unfinished) surface or jagged edge formed in the press-working from damaging the periphery of the terminal insertion opening 101, the front edge 107 of the connection portion 102 is folded inward, as shown in FIG. 8. That is, in the conventional terminal 100, the front surface of the terminal fixture 100 is so formed as to prevent the sharp surface from damaging the resilient sealing member 106.

However, when the operation of pressing the terminal 100 into the opening 101 is performed, a side-wall edge 105 extending from the rear end of the connection portion 102 to the front end of the electrical wire connection portion 103 contacts the periphery of the opening 101. When an operation of removing the terminal 100 from the opening 101 is performed, a rear edge 102A of the connection portion 102 as well as the side wall edge 105 contacts the periphery of the opening 101. That is, in the conventional terminal 100, countermeasures of preventing the sharp surface at the rear portion of the connection portion 102 from damaging the periphery of the opening 101 at the rear portion of the connection portion 102 are not sufficient. Thus, when pressing the terminal 100 into the opening 101 is performed or when removing the terminal 100 therefrom is performed, the resilient sealing member 106 may be damaged.

SUMMARY OF THE INVENTION

It is therefore an object of the present invention to provide an improved connector assembly in which there is a lesser risk that a terminal damages a resilient sealing member on insertion of the terminal into and removal of the terminal from an opening in the resilient sealing member.

Accordingly, a first aspect of the present invention provides a connector assembly including a connector housing, a resilient sealing member installed on the housing, and a terminal. The resilient sealing member has an opening for inserting the terminal, in use, into the connector housing in an insertion direction. The terminal is formed by cutting and bending an electrically conductive plate material and has a matable connection portion with a front end and a rear end. The matable connection portion, in use, is connectable to a complementary terminal of another connector component.

The terminal also includes an electrical wire connection portion. The electrical wire connection portion has a front end and a rear end. In use, the electrical wire connection portion is connectable to an electrical wire. The rear end of the matable connection portion is joined to the front end of the electrical wire connection portion. In a view perpendicular to the insertion direction, a top surface of the rear end of the matable connection portion and a top surface of the front end of the electrical wire connection portion are at different heights relative to a bottom surface of the terminal. The terminal also has a guard member, which is arranged to guide, during insertion of the terminal into and withdrawal of the terminal from the opening, the periphery of the opening between the top surface of the rear end of the matable connection portion and the top surface of the front end of the electrical wire connection portion.

Preferably, the guard member has a top surface inclined with respect to the top surface of the rear end of the matable connection portion and the top surface of said front end of the electrical wire connection portion. The guard member thereby provides a sloping surface between the top surface of the rear end of the matable connection portion and the top surface of the front end of the electrical wire connection portion.

The terminal may be formed as a single piece of the electrically conductive plate material.

Preferably, the guard member may include a pair of lateral upward projections adjacent the front end of the electrical wire connection portion.

Alternatively, the guard member may include a projection joined to the rear end of the matable connection portion.

In use, the terminal is attached to an electrical wire. The electrical wire has an exposed core at the electrical wire connection portion. Preferably, the guard member is higher, with respect to a base of the terminal, than the tip of the core of the electrical wire. On insertion of the terminal into and withdrawal of the terminal from the opening, contact between the periphery of the opening and the tip of the core of the electrical wire is restricted.

A second aspect of the present invention provides an electrical terminal that is securable to an electrical wire. The terminal has a base, a first portion in the form of a matable connection portion standing up from the base and adapted to connect to another terminal, and a second portion in the form of an electrical wire connection portion upstanding from the base and secured to the electrical wire by crimping of material of the terminal. The height of the matable connection portion above the base is greater than that of the electrical wire connection portion, and the terminal further has a guard member upstanding from the base between the first and second portions.

The guard member provides an upward facing portion which forms a transition slope sloping downwardly in the direction from the first portion to the second portion over at least part of the extent of the height difference between the first and second portions.

BRIEF DESCRIPTION OF THE DRAWINGS

Exemplary embodiments of the invention will be described with reference to the accompanying drawings. However, the drawings are not intended to imply limitation of the invention to specific embodiments, but are for explanation and understanding only.

In the drawings.

DETAILED DESCRIPTION OF PREFERRED EMBODIMENTS

A first embodiment of the present invention is described below with reference to FIGS. 1 to 4.

Figure 1:
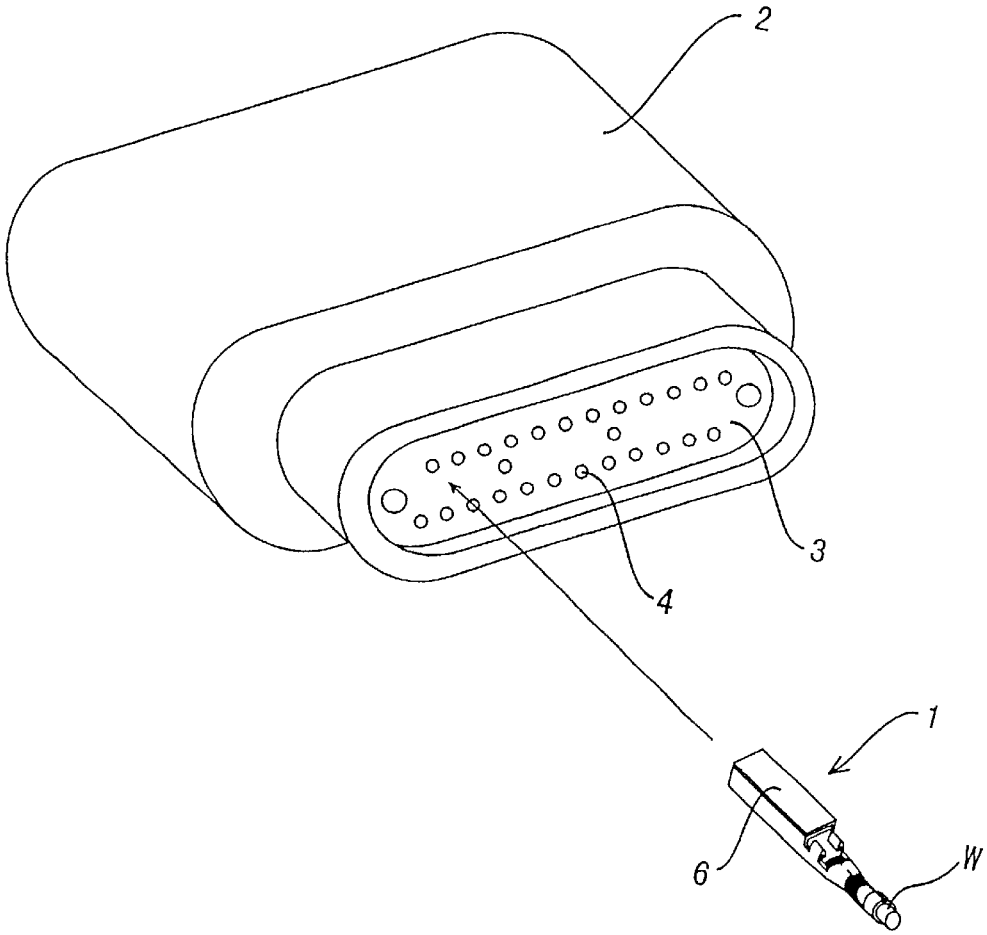
FIG. 1 is a perspective view of a terminal before it is pressed into a terminal insertion opening of a resilient sealing member in a first embodiment of the present invention.

FIG. 1 shows a terminal 1 before it is installed in a connector housing 2. The connector housing 2 has a sealing member 3 formed from a resilient material. The sealing member 3 has a plurality of terminal insertion openings 4 into which terminals such as the terminal 1 are pressed, respectively. In each opening 4, at least one convexity 11 (see FIG. 4) having a diameter smaller than the outer diameter of an electrical wire W connected to the terminals is formed along the entire inner circumferential surface. When the terminal 1 is pressed into the opening 4, the convexity 11 is brought into close contact with the outer surface of the coating of the wire W while the convexity 11 is deforming elastically. As a result, a substantially watertight seal is formed.

The terminal 1 may be formed by cutting and bending an electrically conductive plate material. The electrically conductive plate material may be cut using a press. The terminal 1 is connected with one end of the electrical wire W and installed in the connector housing 2. A box-shaped connection portion 6 to be connected with a mating male-side terminal (not shown) is provided at the front side of the terminal 1. The outer dimensions of the connection portion 6 are larger than the diameter of the opening 4. When the terminal 1 is pressed into the opening 4, it elastically expands the periphery of the opening 4.

Figure 2:
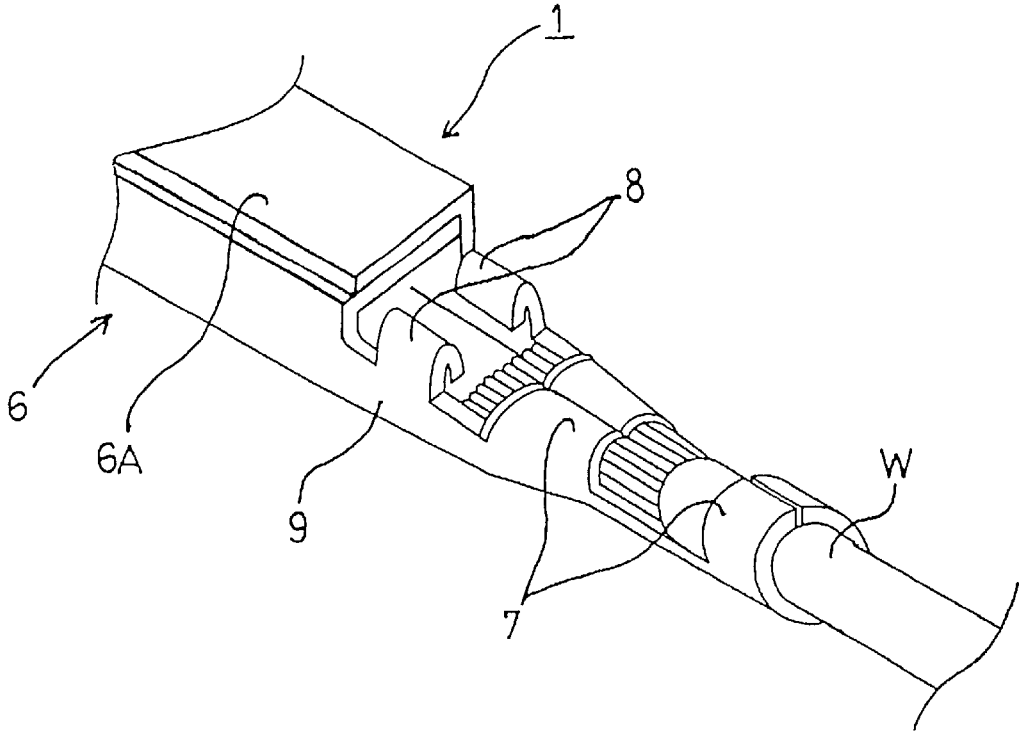
FIG. 2 is a partial perspective view of the terminal shown in FIG. 1.
Figure 3:
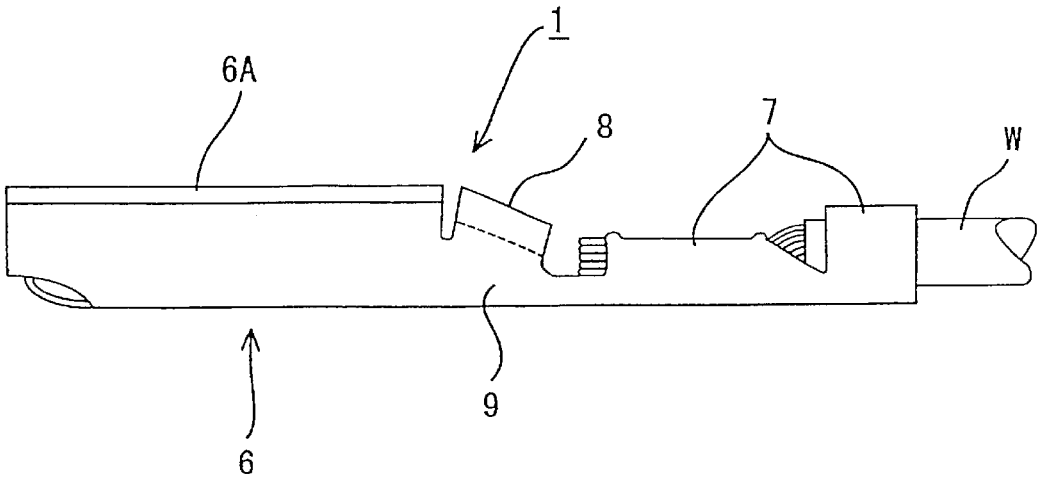
FIG. 3 is a side view of the terminal shown in FIG. 1.
Figure 4:
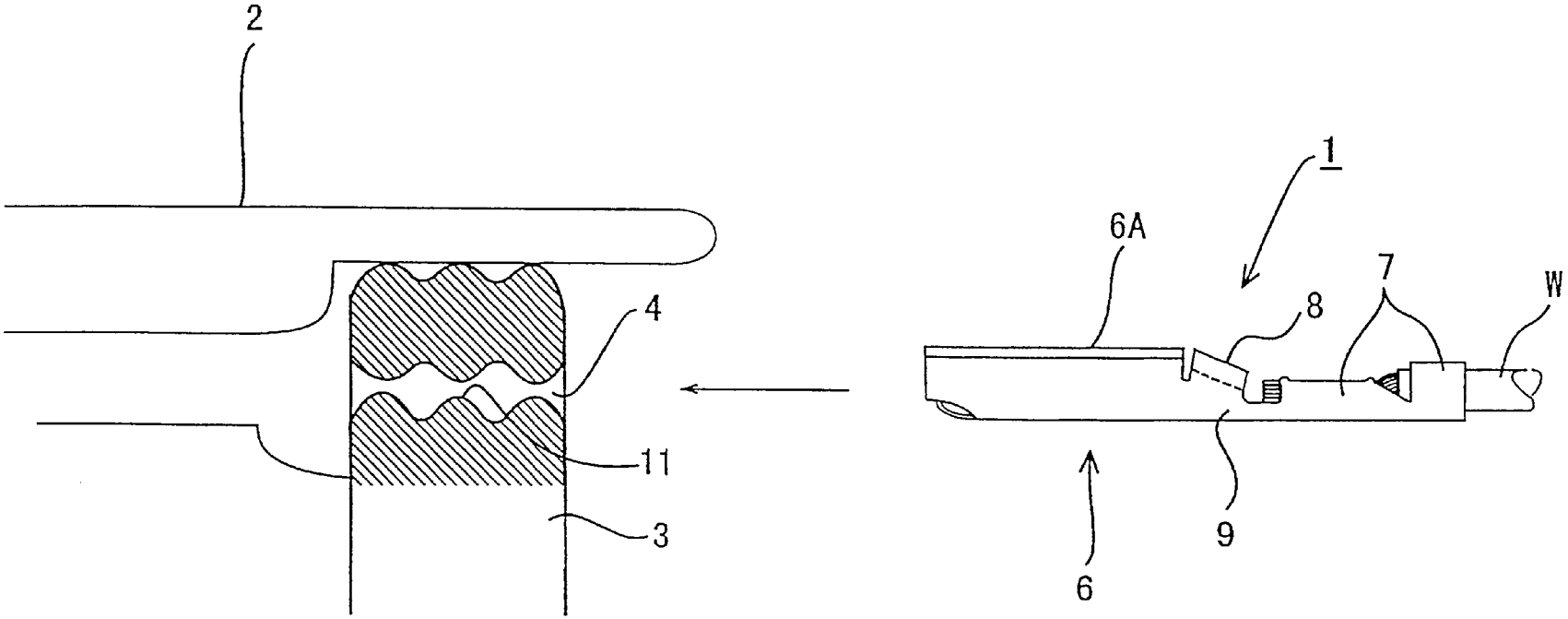
FIG. 4 is a sectional side elevation of the terminal shown in FIG. 1 before it is pressed into the terminal insertion opening of the resilient sealing member.

As shown in FIG. 2, at least one wire connection portion 7 that can be connected with the electrical wire W is provided rearward from the connection portion 6. An uppermost surface 6A of the connection portion 6 is higher, with respect to a flat base of the terminal, than the wire connection portion 7.

In this embodiment, there are two wire connection portions 7 and there is a gap between the two wire connection portions 7.

A pair of right and left guard members 8 is provided between the uppermost surface 6A of the connection portion 6 and the nearest wire connection portion 7. Each guard member 8 extends upward from a side wall 9 and is folded inward, i.e., towards the other guard member, from a position in the vicinity of its center in the height direction. Because the upper end of the guard member 8 is thus folded, a sharp edge formed in press working is directed downward. The entire upper surface of the guard member 8 inclines downwardly from its front end to its rear end (see FIG. 3).

The operation and some effects of this embodiment will be described below.

When an operation of pressing the terminal 1 into the opening 4 is performed, the periphery 10 of the opening 4 expands elastically. When the connection portion 6 has passed the periphery 10 of the opening 4, the periphery 10 is elastically restored to its original state. The periphery 10 is elastically restored to the level of the wire connection portion 7 from the level of the uppermost surface 6A while contacting with the upper surface of the guard members 8, so the periphery 10 is deformed gradually and smoothly as it slides along the slope of the upper surface of the guard members 8.

When the wire connection portions 7 pass the periphery 10 of the opening 4, the convexity 11 contacts the peripheral surface of the wire W. As a result, a substantially watertight seal is formed between the convexity 11 and the peripheral surface of the wire W.

As described above, according to this embodiment, because the guard members 8 are provided between the uppermost surface 6A of the connection portion 6 and the nearest electric wire connection portion 7, no sharp end contacts the periphery 10 of the opening 4 while the terminal 1 is pressed into the opening 4 of the resilient sealing member 3. Thus, risk of damage of the resilient sealing member 3 is reduced.

Further, because the guard members 8 incline, the edge of the terminal 1 acts progressively on the periphery 10 of the opening 4 when the terminal 1 is inserted into the opening 4 and removed therefrom. Therefore, it is possible to prevent an impact from being applied to the periphery 10, which also reduces risk of damage of the resilient sealing member 3.

Figure 5:
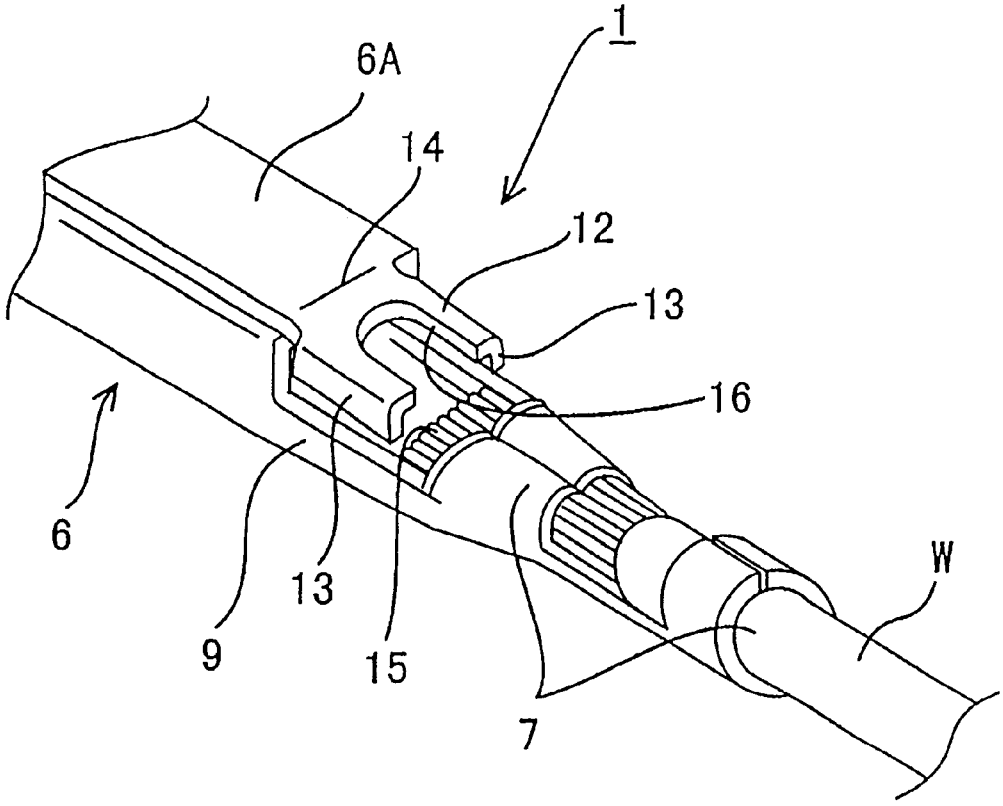
FIG. 5 is a partial perspective view of a terminal of a second embodiment of the present invention.
Figure 6:
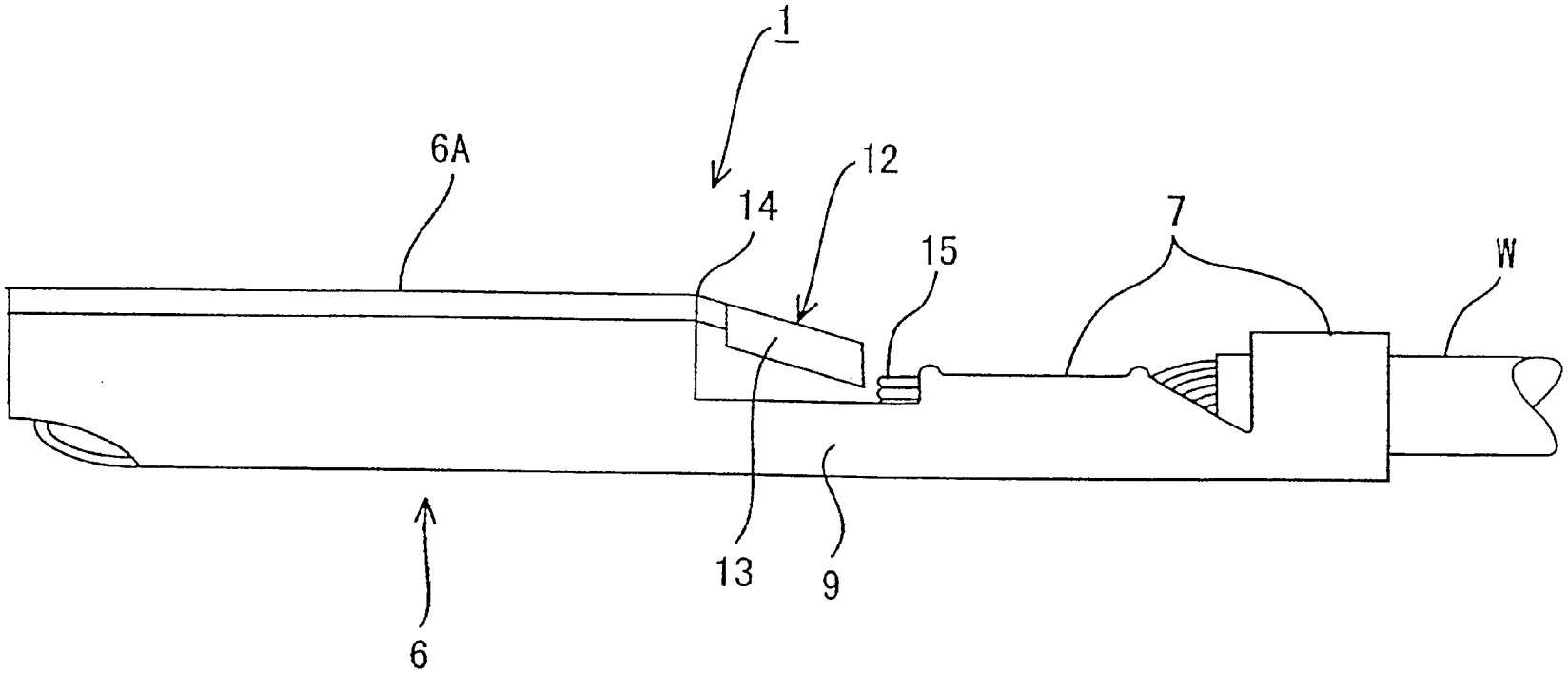
FIG. 6 is a side view of the terminal shown in FIG. 5.
Figure 7:
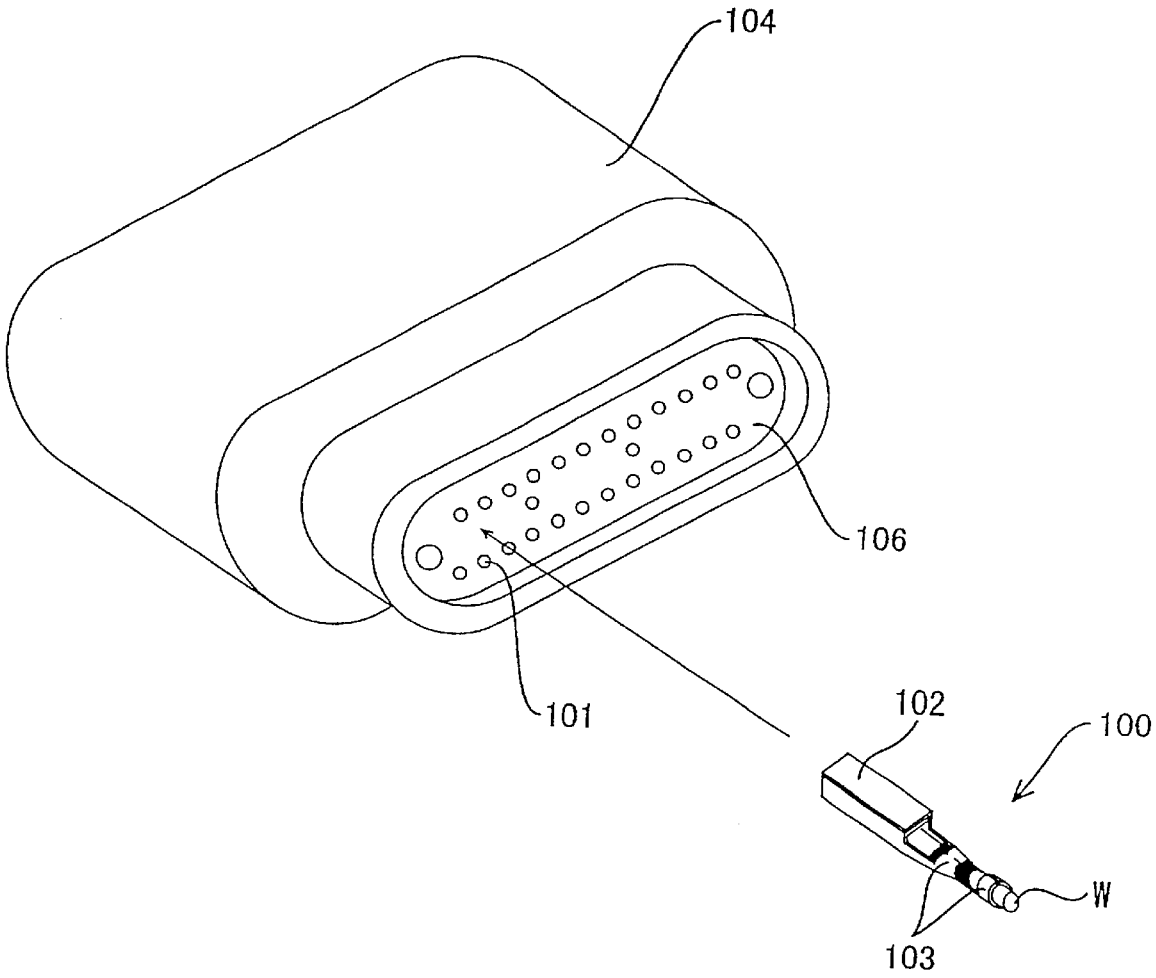
Fig. 7 Prior Art
FIG. 7 is a perspective view of a conventional terminal before it is pressed into a terminal insertion opening of a resilient sealing member.
Figure 8:
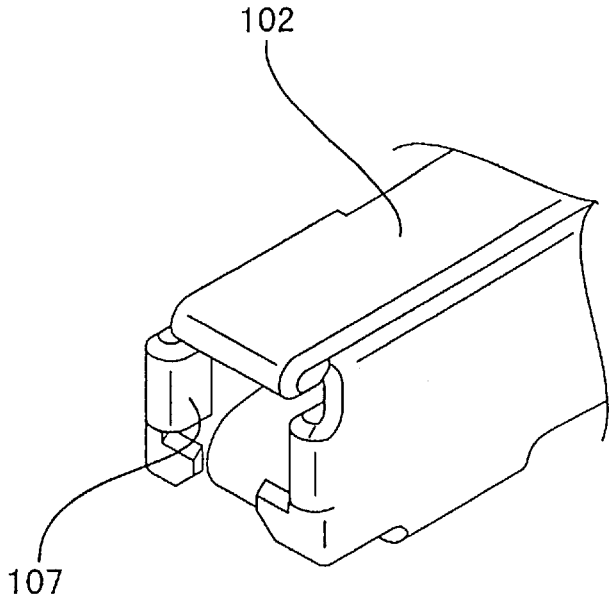
Fig. 8 Prior Art
FIG. 8 is a perspective view of a front portion of the terminal of FIG. 7.
Figure 9:
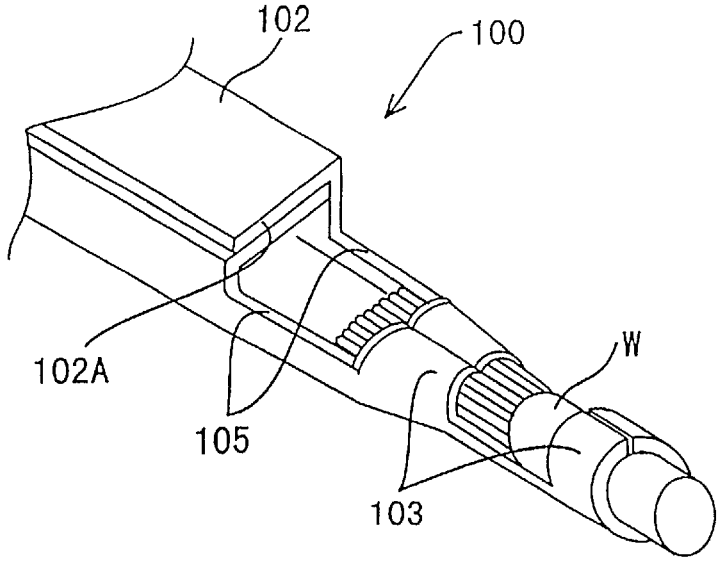
Fig. 9 Prior Art
FIG. 9 is a perspective view of a rear portion of the terminal of FIG. 7.

A second embodiment of the present invention will be described below with reference to FIGS. 5 and 6.

In the description of the second embodiment, parts of the second embodiment having the same operation as that of the parts of the first embodiment are denoted by the same reference numerals as those of the first embodiment and will not be described again.

The second embodiment is different from the first embodiment in the construction of the guard member. In the second embodiment, a guard member 12 is formed integrally with the uppermost surface 6A of the connection portion 6. The two side portions 13 of the guard member 12 are bent downward and the sharp edge formed during cutting is directed inward. The rear end of the guard member 12 is bent downward, thus connecting the rear end of the uppermost surface 6A and the front end of the nearest wire connection portion 7 to each other, with the guard member 12 being interposed between the side walls 9. The guard member 12 thus provides a sloping upper surface extending obliquely downwardly from the rear end 14 of the upper surface of the connection portion 6.

The rear end of the guard member 12 is located obliquely upward from the wire core 15 of the electrical wire W connected with the wire connection portion 7, and is thus higher, with respect to a bottom surface of the terminal, than a tip of the core 15. An electrical wire insertion groove 16 is formed at the center of the guard member 12 and extends forward from the rear end of the guard member 12 to prevent the wire W from interfering with the guard member 12 when the wire W is installed on the terminal 1.

The second embodiment thus constructed has an effect similar to that of the first embodiment.

In the second embodiment, the guard member 12 is higher than the tip of the core 15. Therefore, it is possible to prevent the tip of the core 15 from damaging the resilient sealing member 3 when the terminal 1 is pressed into the opening 4.

The present invention is not limited by the embodiments described and encompasses all embodiments within the spirit and scope of the invention as herein described. For example the female-side terminal is described in the embodiments, but the present invention is also applicable to a male-side terminal.

What is claimed is:

1. A connector assembly including a connector housing, a resilient sealing member installed in said connector housing and a terminal, said resilient sealing member having an opening through which the terminal is insertable into the connector housing in an insertion direction, the terminal being formed by cutting and bending an electrically conductive plate material and comprising:

a matable connection portion having a front end and a rear end, the matable connection portion being connectable to a complementary terminal of another connector component; and an electrical wire connection portion having a front end and a rear end, the electrical wire connection portion being connectable to an electrical wire, the rear end of the matable connection portion being joined to the front end of the electrical wire connection portion and a top surface of the rear end of said matable connection portion and a top surface of the front end of said electrical wire connection portion being at different heights relative to a bottom surface of the terminal; and a guard member arranged to guide, during insertion of the terminal into and withdrawal of the terminal from said opening, a periphery of the opening between the top surface of the rear end of the matable connection portion and the top surface of the front end of the electrical wire connection portion, said guard member comprising a pair of lateral upward projections and having a top portion inclined with respect to the top surface of the rear end of the matable connection portion and the top surface of the front end of the electrical wire connection portion, thereby providing a slope between the top surface of the rear end of the matable connection portion and the top surface of the front end of the electrical wire connection portion.

2. A connector assembly according to claim 1, wherein said terminal is formed as a single piece of said electrically conductive plate material.

3. A connector assembly according to claim 1, wherein each of said upward projections is folded over inwardly to form a fold line at a top edge of the projection.

4. A connector assembly including a connector housing, a resilient sealing member installed in said connector housing and a terminal, said resilient sealing member having an opening through which the terminal is insertable into the connector housing in an insertion direction, the terminal being formed by cutting and bending an electrically conductive plate material and comprising:

a matable connection portion having a front end and a rear end, the matable connection portion being connectable to a complementary terminal of another connector component: and an electrical wire connection portion having a front end and a rear end, the electrical wire connection portion being connectable to an electrical wire, the rear end of the matable connection portion being joined to the front end of the electrical wire connection portion and a top surface of the rear end of said matable connection portion and a top surface of the front end of said electrical wire connection portion being at different heights relative to a bottom surface of the terminal; and a guard member arranged to guide, during insertion of the terminal into and withdrawal of the terminal from said opening a periphery of the opening between the top surface of the rear end of the matable connection portion and the top surface of the front end of the electrical wire connection portion, said guard member comprising a projection joined to said rear end of said matable connection portion, inclined with respect to the top surface of the rear end and having a rear portion with a generally U-shaped cut out recess that prevents an end of an electrical wire connected to said connection portion from interfering with the terminal.

5. A connector assembly according to claim 4, wherein said guard member has two laterally spaced top outer edges formed by respective bend lines.

6. A connector assembly according to claim 1, wherein the terminal is attached to an electrical wire, which has an exposed core at said electrical wire connection portion, and said guard member has a rear end which is higher, with respect to the bottom surface of the terminal, than a tip of said core of said electrical wire whereby, on insertion of the terminal into and withdrawal of the terminal from the opening, contact between the periphery of the opening and the tip of the core of the electrical wire is restricted.

7. An electrical terminal that is securable to an electrical wire, said terminal comprising:

a base;

a first portion in the form of a matable connection portion standing up from said base and adapted to connect to another terminal;

a second portion in the form of an electrical wire connection portion upstanding from said base and secured to said electrical wire by crimping of material of the terminal, a height of said first portion above said base being greater than that of said second portion; and a guard member comprising a pair of lateral upward projections upstanding from said base between said first and second portions and providing an upward facing portion that forms a transition slope sloping downwardly in a direction from said first portion to said second portion over at least part of an extent of a height difference between said first and second portions.

8. A terminal according to claim 7, wherein each of said upward projections is folded over inwardly to form a fold line at a top edge of the projection.

9. An electrical terminal that is securable to an electrical wire, said terminal comprising:

a base;

a first portion in the form of matable connection portion standing up from said base and adapted to connect to another terminal;

a second portion in the form of an electrical wire connection portion upstanding from said base and secured to said electrical wire by crimping of material of the terminal, a height of said first portion above said base being greater than that of said second portion; and a guard member positioned between said first and second portions and providing an upward facing portion that forms a transition slope sloping downwardly in a direction from said first portion to said second portion over at least part of an extent of a height difference between said first and second portions, said guard member comprising a projection joined to a rear of the matable connection portion and having a rear portion with a generally U-shaped cut out recess that prevents an end of the electrical wire from interfering with the terminal.

10. A terminal according to clam 9, wherein said guard member has two laterally spaced top outer edges formed by respective bend lines.

* * * * *

UNITED STATES PATENT AND TRADEMARK OFFICE
Certificate

Patent No. 6,287,157 B1 Patented: September 11, 2001

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: is: Izumi Suzuki, Yokkaichi, Japan; Yukihiro Fukatsu, Yokkaichi, Japan; Yasumitsu Makita, Yokkaichi, Japan; Atsushi Sakatani, Yokkaichi, Japan; and Shinya Fujita, Yokkaichi, Japan.

Signed and Sealed this Twenty-eighth Day of September 2004.

TULSIDAS C. PATEL
*Supervisory Patent Examiner*
Art Unit 2839